US008882933B2

(12) United States Patent
Assmann et al.

(10) Patent No.: US 8,882,933 B2
(45) Date of Patent: Nov. 11, 2014

(54) DISHWASHER HAVING A DEVICE FOR OPENING THE DOOR IN GAPS

(75) Inventors: Walter Assmann, Bielefeld (DE); Dirk Wegener, Bielefeld (DE); Stefan Tiekoetter, Bielefeld (DE); Volker Marks, Bielefeld (DE); Cornelius Wolf, Bielefeld (DE); Markus Druecker, Guetersloh (DE); Benjamin Held, Bad Oeynhausen (DE); David Buhl, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 1015 days.

(21) Appl. No.: 12/995,508

(22) PCT Filed: Jun. 2, 2009

(86) PCT No.: PCT/EP2009/003912

§ 371 (c)(1),
(2), (4) Date: Dec. 1, 2010

(87) PCT Pub. No.: WO2009/146874

PCT Pub. Date: Dec. 10, 2009

(65) Prior Publication Data

US 2011/0074261 A1 Mar. 31, 2011

(30) Foreign Application Priority Data

Jun. 2, 2008 (DE) ..... 10 2008 026 277
Jun. 2, 2008 (DE) ..... 10 2008 026 280
Jun. 2, 2008 (DE) ..... 10 2008 026 281

(51) Int. Cl.
*A47L 15/42* (2006.01)
*A47L 15/48* (2006.01)
*A47L 15/00* (2006.01)

(52) U.S. Cl.
CPC ..... *A47L 15/4261* (2013.01); *A47L 15/0034* (2013.01); *A47L 2501/22* (2013.01); *A47L 15/4259* (2013.01); *A47L 15/488* (2013.01); *E05Y 2900/304* (2013.01); *E05Y 2201/424* (2013.01); *A47L 2401/20* (2013.01)
USPC ..... 134/57 DL; 134/58 DL

(58) Field of Classification Search
CPC ..... A47L 15/4259; A47L 15/4261; A47L 15/488; A47L 2501/22; A47L 2401/20; A47L 15/0034; E05Y 2900/304; E05Y 2201/424
USPC ..... 134/57 DL, 58 DL
See application file for complete search history.

(56) References Cited

U.S. PATENT DOCUMENTS 2,759,485 A * 8/1956 Guth ..... 134/58 DL
3,486,782 A * 12/1969 Zanussi ..... 292/177

(Continued)

FOREIGN PATENT DOCUMENTS

DE 4443849 A1 6/1996
DE 102005028449 B4 12/2006

(Continued)

OTHER PUBLICATIONS

Machine Translation of DE 102005028449 to Wegener et al., Dec. 2006.*

(Continued)

*Primary Examiner* — Michael Barr
*Assistant Examiner* — Benjamin L Osterhout
(74) *Attorney, Agent, or Firm* — Leydig, Voit & Mayer, Ltd.

(57) ABSTRACT

A dishwasher includes a washing tub, a latch keeper disposed on the washing tub and mounted on a push rod, and a pivotable door configured to close the washing tub. The door includes a latching mechanism configured to engage the latch keeper in accordance with a closing of the door. An actuator is configured to move the push rod in an opening direction so as to open the door to an ajar position. A return device is configured to return the latch keeper in a direction opposite to the opening direction approximately at least to an initial position upon a further opening of the door.

16 Claims, 9 Drawing Sheets

(56) References Cited

U.S. PATENT DOCUMENTS

| | | | | |
|---|---|---|---|---|
| 3,535,896 | A * | 10/1970 | Brown et al. | 68/12.26 |
| 3,944,767 | A * | 3/1976 | Rabuffetti | 200/61.62 |
| 3,968,984 | A | 7/1976 | Guth | |
| 4,951,693 | A | 8/1990 | Archambault | |
| 2004/0163684 | A1 | 8/2004 | Hapke | |
| 2006/0283482 | A1 | 12/2006 | Berends | |
| 2007/0256715 | A1 * | 11/2007 | Oppel et al. | 134/57 DL |

FOREIGN PATENT DOCUMENTS

| | | | |
|---|---|---|---|
| DE | 102006054414 | B3 | 1/2008 |
| EP | 0687439 | A1 | 12/1995 |
| EP | 1402809 | B1 | 3/2004 |

OTHER PUBLICATIONS

Search report for International Application No. PCT/EP2009/003912, mailed on Nov. 18, 2009.

* cited by examiner

DISHWASHER HAVING A DEVICE FOR OPENING THE DOOR IN GAPS

CROSS REFERENCE TO RELATED APPLICATIONS

This application is a U.S. National Phase application under 35 U.S.C. §371 of International Application No. PCT/EP2009/003912, filed on Jun. 2, 2009, and claims benefit to German Patent Application No. DE 10 2008 026 280.3, filed on Jun. 2, 2008, German Patent Application No. DE 10 2008 026 277.3, filed on Jun. 2, 2008 and German Patent Application No. DE 10 2008 026 281.1, filed on Jun. 2, 2008. The International Application was published in German on Dec. 10, 2009 as WO 2009/146874 A1 under PCT Article 21 (2).

FIELD

The present invention relates to a dishwasher including a washing tub which can be closed by a pivotable door and a push rod which can be moved in the opening direction by an actuator to open the door to an ajar position.

BACKGROUND

German Patent Application DE 44 43 849 A1 describes a push rod which is eccentrically mounted to a motor and is thus capable of automatically opening the washing tub door to an ajar position after completion of the wash and rinse cycles, allowing the residual moisture to escape by natural convection. Although the opening mechanism described in that publication improves the drying process, problems still arise because the described opening mechanism allows an opening gap of only ten millimeters. A longer opening stroke is advantageous especially when the dishwasher is integrated into a row of kitchen units and covered on top by a countertop. In the design described in DE 44 43 849 A1, the warm, moisture-laden air condenses on the underside of the cold countertop, which may result in damage thereto.

DE 10 2006 054 414 B3 describes a door with a door lock for engagement of a latch keeper.

European Patent Application EP 0 687 439 A1 describes a dishwasher in which the door is likewise opened to an ajar position after completion of the wash and rinse cycles by means of a latch keeper that can be displaced by motor means. Here, the latch keeper remains in this slightly open position after the end of the cycle. As a result, it should be easier for the user to close the door after unloading the appliance because the push rod is then pulled to its end position by the motor. A disadvantage of this approach is that the opening gap has to be large during assisted drying (see above) and, therefore, the latch keeper protrudes far into the room even after the user has opened the door. In this position, the latch keeper poses a risk of an injury and can easily be damaged.

German Patent DE 10 2005 028 449 B4 describes a dishwasher in which the latch keeper can be moved to three different positions by an electric motor. The first position is the initial position of the latch keeper, in which the door is fully closed to enable a washing operation to be performed. At the end of the cycle, the latch keeper is moved from said first position to a second position wherein the door is ajar, leaving a relatively large gap. This assists in the drying process. After the door is opened, the latch keeper is retracted to a third position. In this position, the latch keeper projects from the housing only to such an extent that the door will remain in an only slightly ajar position upon closure. In this position, there is a reduced risk of injury. In addition, automatic retraction of the latch keeper to the first position assists the user in closing the door, since he or she no longer has to push against the force of the door seal.

In the dishwashers described above, an electric gear motor is used as the actuator. This motor is expensive and susceptible to wear. In addition, two position switches are employed.

SUMMARY

In an embodiment, the present invention provides a dishwasher including a washing tub, a latch keeper disposed on the washing tub and mounted on a push rod, and a pivotable door configured to close the washing tub. The door includes a latching mechanism configured to engage the latch keeper for a closing of the door. An actuator is configured to move the push rod in an opening direction so as to open the door to an ajar position. A return device is configured to return the latch keeper in a direction opposite to the opening direction approximately at least to an initial position upon a further opening of the door.

BRIEF DESCRIPTION OF THE DRAWINGS

Exemplary embodiments of the present inventions described in more detail below and shown schematically in the drawings, in which.

DETAILED DESCRIPTION

Figure 1:
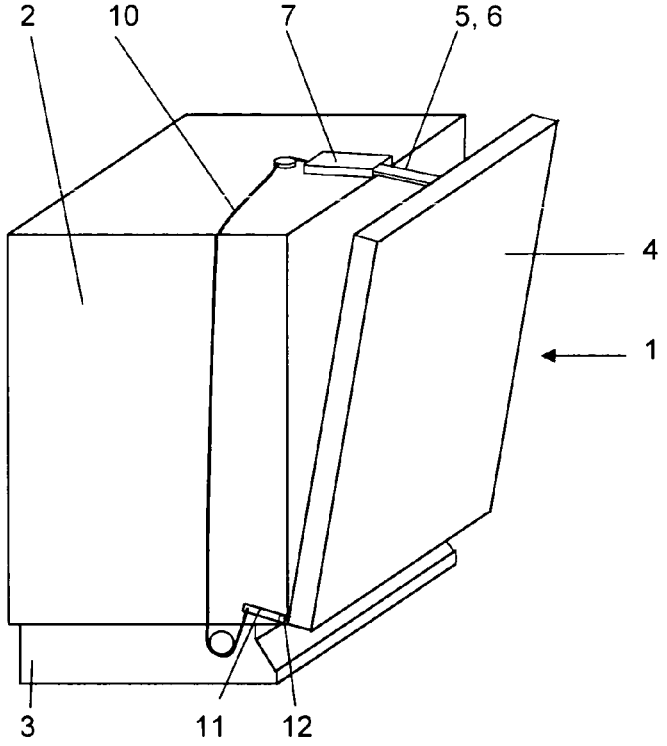
FIG. 1 shows a dishwasher having a device for automatic opening of the door.

In an embodiment, the present invention provides a dishwasher including a washing tub which can be closed by a pivotable door the closing being accomplished by engagement of a latching mechanism disposed on the door with a latch keeper disposed on the washing tub, the latch keeper being mounted on a push rod which can be moved in the opening direction by an actuator to open the door to an ajar position. Automatic retraction of the latch keeper can be implemented even when the electric gear motor conventionally used is replaced with a less expensive actuator.

In an embodiment, the present invention provides a dishwasher that uses a device which returns the latch keeper in a direction opposite to the opening direction to at least approximately its initial position as the door is opened further. This makes it possible to use more economical and rugged actuators in place of an electric motor.

In an embodiment, these return device includes a cable, such as a Bowden cable, coupled to the door. In this manner, a simple mechanical linkage is provided which allows the force exerted by the user on the door during opening to be used to return the latch keeper.

In this connection, the door may operate the cable or Bowden cable via a pivoted direction-changing lever. A result of the use of this device is that the retraction mechanism is not permanently coupled to the door. In this manner, wear is minimized because the push rod is retracted only once per cycle. Moreover, the unfavorable direction of movement of the door in the hinge area is also eliminated. The direction-changing lever converts the upward motion of the door hinge into a downward motion, and thus automatically into a pulling motion. This eliminates the need for any additional pulleys. It is convenient if the direction-changing lever has two arms, the first arm being movable by the door, and the second arm having the cable or Bowden cable attached thereto.

A simple mechanical design is achieved if the direction-changing lever is mounted to a support plate. Such a plate may be attached in a simple manner to the side wall of the washing tub, or to a component mounted on the side wall, so that there is no need to further modify the design of the dishwasher.

An inexpensive actuator of simple design for moving the push rod includes at least one spring. This spring can be stretched in a direction opposite to the opening direction of the push rod as the door is opened further. The push rod may be lockable in at least one position in which the spring is tensioned.

In an embodiment, the push rod is lockable in the initial position and in a pre-latched position located before the initial position. This ensures that the latch can engage the latch keeper, even if the latching mechanism of the door lock has a short free stroke. In order to ensure that the door is closed tight during the washing operation, the push rod can be moved from the pre-latched position to the initial position as the door is opened to a predetermined minimum angle.

To enable the door to be opened in a program-controlled manner at the end of the cycle without user intervention, an actuator may be used that is actuatable by a controller and which allows the position-locking mechanism of the push rod to be released. In an embodiment, a thermal actuator may be used for releasing the position-locking mechanism of the push rod. After the position-locking mechanism is released, the push rod can remain in an intermediate position until the thermal actuator cools down. This ensures that the position-locking mechanism of the push rod is operational again as soon as the position-locking mechanism leaves the intermediate position. This allows the user to close the door again immediately after it has been automatically opened.

In another embodiment, a solenoid is used for releasing the position-locking mechanism of the push rod.

FIG. 1 shows, schematically, parts of a dishwasher 1, namely washing tub 2, base 3, which is located below the washing tub, and door 4, which is hinged in the lower region of washing tub 2. These components are shown in greater detail in FIGS. 7 through 10. The door 4 is provided with a door lock for engagement of a latch keeper 5 (see FIGS. 4*b* and 11 through 16).

In order to allow the door to be automatically opened to an ajar position in a program-controlled manner, latch keeper 5, which is located between the cover portion and washing tub 2 of dishwasher 1, is extended by an approximately 100 mm long push rod 6, which is movable in the opening and closing directions. This push rod 6 is movably accommodated in a housing 7 and is biased by two tension springs 8 in the retracted position when door 4 is closed (see FIG. 2). To enable push rod 6 to be latched in position while tension springs 8 are tensioned, provision is made for a position-locking mechanism 9 which is shown in greater detail in FIGS. 11 through 16 and will be described later herein. This position-locking mechanism may, in turn, be released by a controller, preferably the cycle controller, via a release device 15 (including, for example, a thermal, bimetal or memory metal actuator, solenoid). After position-locking mechanism 9 is released, tension springs 8 move push rod 6 about 100 mm to the opening position, as a result of which door 4 is moved in this direction to an ajar position with latch keeper 5 engaged in the lock (see FIG. 1 and FIGS. 3*a* and *b*). When door 4 is in the ajar position, preferably at the end of the cycle, the air in washing tub 2 can be exchanged at a higher rate, thereby improving the drying and cooling of the dishes (not shown). After door 4 is automatically opened, latch keeper 5 remains in the door lock until the user operates a door-opening mechanism and fully opens door 4.

Figure 2:
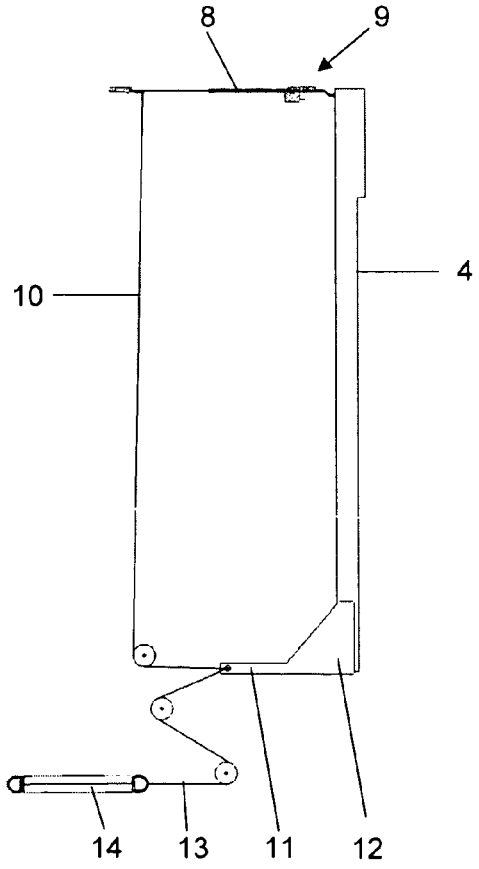
FIG. 2 shows a side view of the door and a latch keeper returning device.

In order to allow door 4 to be automatically opened again the next time a wash cycle is performed, tension springs 8 need to be tensioned again. To this end, the rear portion of pull rod 6 is connected via a pull cable system 10 to a cantilever 11 in the region of door hinge 12. This cantilever is also connected to another tension spring 14 via another pull cable 13 in a conventional manner (FIGS. 2 through 4). Spring 14 balances the weight of door 4 to make opening easier for the user. Full opening of door 4 causes pull rod 6 to be retracted via pull cable system 10 until position-locking mechanism 9 snaps into a latched position again. The system is then ready for the next automatic opening operation at the end of a cycle.

Blocking of door 4, which may be caused, for example, by an obstacle or a person standing in front of the appliance, is not a problem and is accommodated by tension springs 8, which eliminates the need for slip coupling means or any other safety feature. In the event that door 4 is manually opened during the cycle, push rod 6 remains in the locked position.

The system makes do with an inexpensive actuator and, besides pull cable 10 and springs 8, needs only one position switch for detecting when the door is in a closed position. This eliminates the need for a second position switch and an expensive gear motor.

FIGS. 5 through 10 illustrate a further exemplary embodiment of a device which returns latch keeper 5 in a direction opposite to the opening direction to at least approximately its initial position as the door is opened further. Here, a direction-changing lever 20 is used in place of the direct coupling via the pull cable.

Figure 4A:
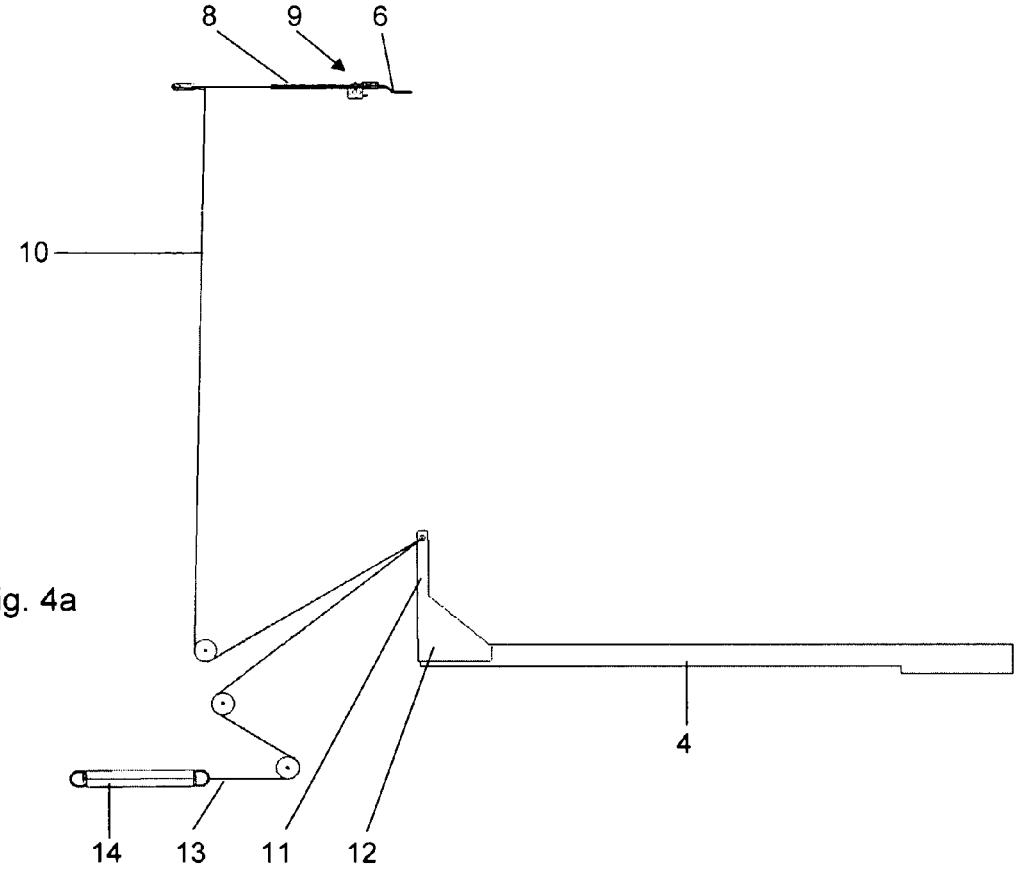
FIGS. 4*a* and 4*b* are side and top views of the door and the latch keeper returning device, with the door in a fully open position.
Figure 4B:
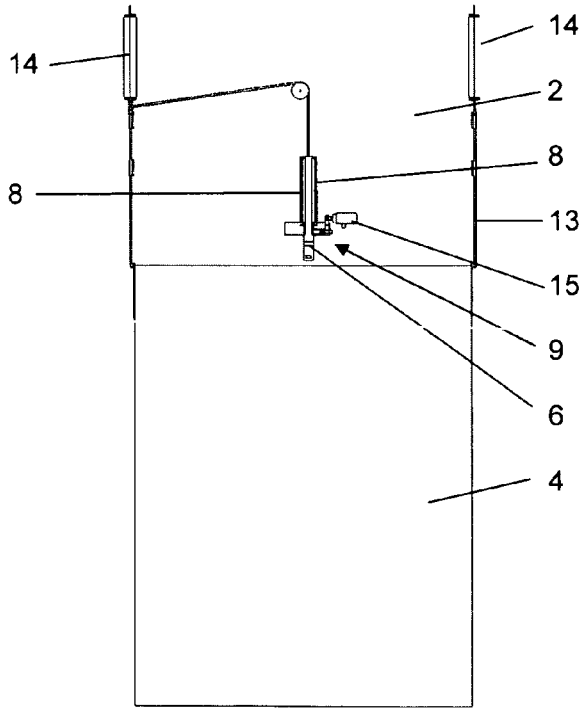
Figure 5B:
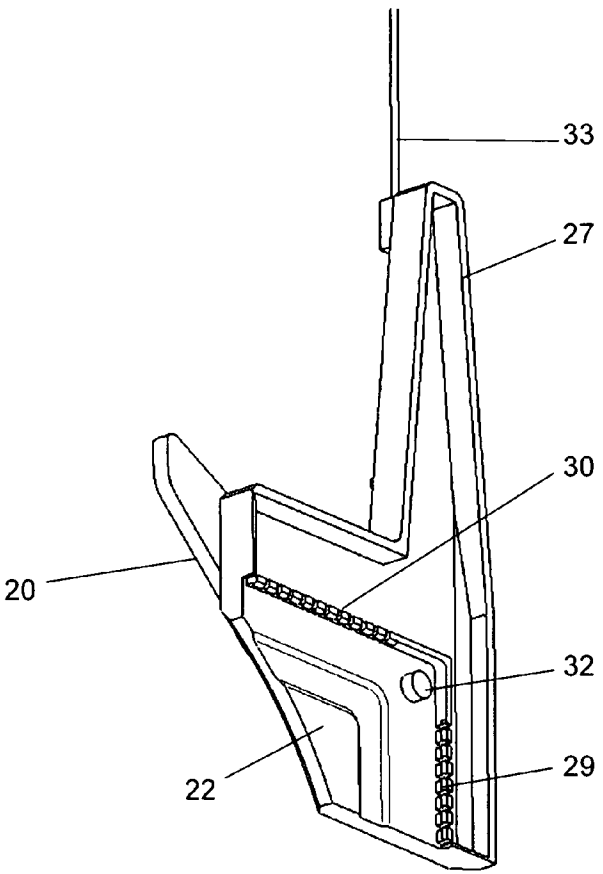
FIGS. 5*a* and 5*b* are front and rear views of a direction-changing lever assembly.
Figure 5A:
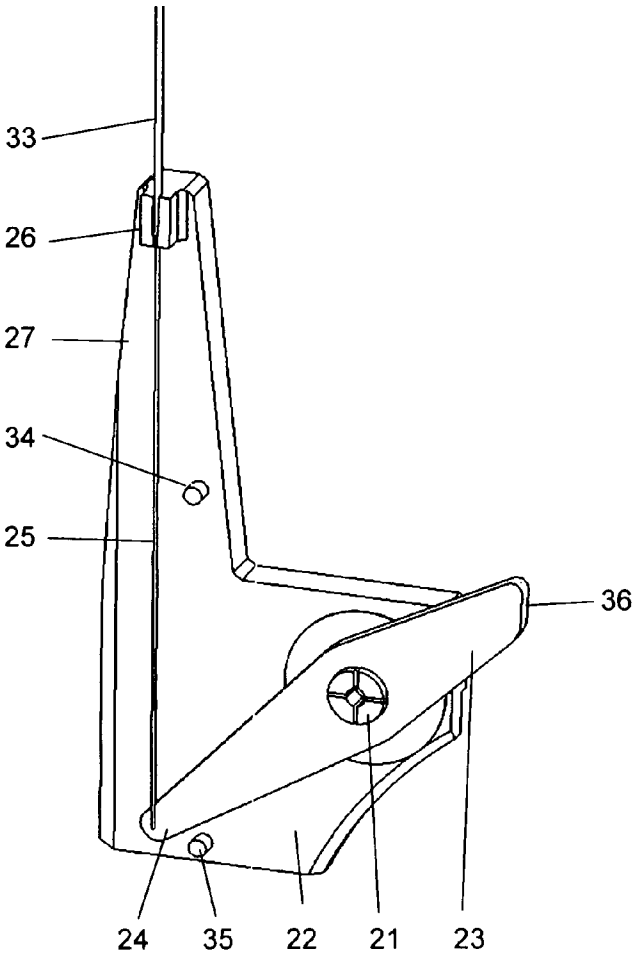
Figure 6:
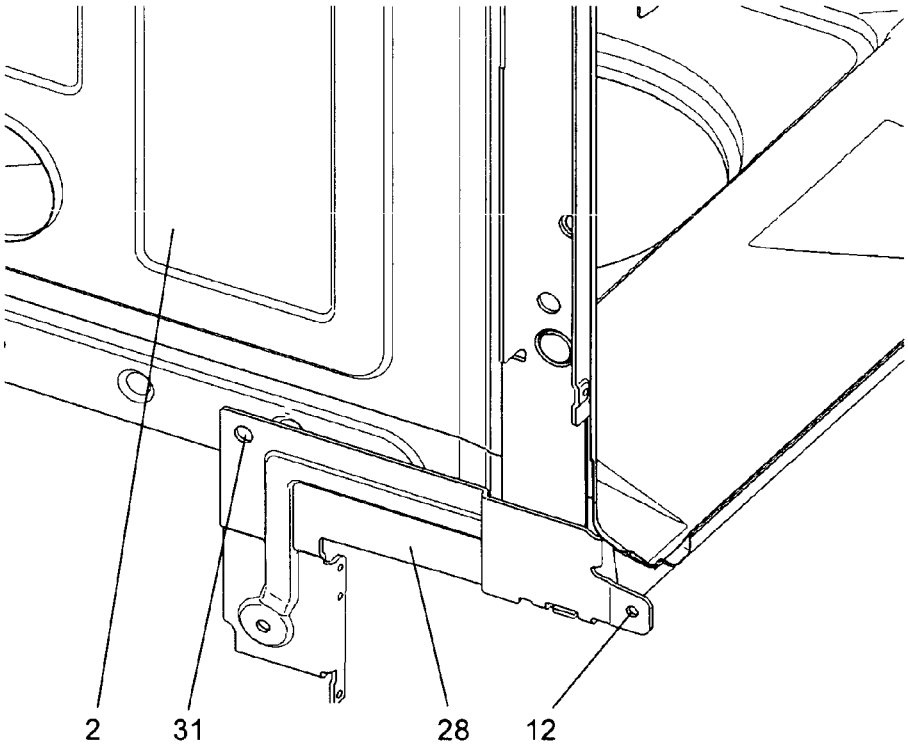
FIG. 6 shows a washing tub of a dishwasher prior the mounting of the direction-changing lever assembly.

Mechanical Construction of the Embodiment that Uses a Direction-Changing Lever:

Direction-changing lever 20 is rotatably mounted by a pivot pin 21 to a support plate 22 (see FIG. 5*a*). The direction-changing lever has two arms. As will be described later, first arm 23 is movable by door 4, and second arm 24 has a Bowden cable 25 attached thereto. The Bowden cable's outer sheath 33 is secured in a guide portion 26 of a cantilever 27 of support plate 22. The so-guided Bowden cable 25 is connected at the top to push rod 6 (see FIGS. 1 through 4).

The back side of support plate 22 (FIG. 5*b*) is configured to allow the support plate to be snapped onto an elbow-shaped plate member 28 (see FIG. 6), which is disposed in the front area of dishwasher 1 and serves as a support. For this purpose, the support plate has latching noses 29 and 30 formed on two edges that surround elbow-shaped plate member 28. Moreover, in order to achieve the stability required to accommodate the retraction movement of push rod 6, the rear contour of support plate 22 is matched the contour of elbow-shaped plate member 28. In addition, a hole 31, which is formed in elbow-shaped plate member 28 during manufacture, is engaged by a pin 32 as a further holding member.

Direction-changing lever 20 and support plate 22 are so designed in terms of geometry that a door-opening angle of 45° is sufficient to provide a path length of about 100, which is required to accommodate the retraction movement of push rod 6. The two end positions of direction-changing lever 20 and the guide of Bowden cable 25 are located in one line, so that the Bowden cable's outer sheath 33 does not bend as Bowden cable 25 is pulled in or drawn out, which has a positive effect on service life. Stop members 34 and 35 formed on support plate 22 may serve as limit stops for direction-changing lever 20, which facilitates the mounting of the assembly to elbow-shaped plate member 28.

First arm 23 has a contour 36 which comes into contact with cantilever 11 of door hinge 12 and is adapted to allow cantilever 11 to slide thereon so as to reduce wear. Bowden cable 25 may be connected to second arm 24 via a fitting, an eye, or simply by a wire end shaped like a "Z". Although, due to the mechanical design, almost no tolerance-related variations are to be expected, it may be useful to provide means making it possible to compensate for tolerances. This may be achieved using, for example, an adjusting nut which may be disposed, for example, on cantilever 27 of support plate 22. The adjusting nut could then be used to move the sheath 33 of the Bowden cable relative to support plate 22 so as to achieve the desired retraction length in different positions of the direction-changing lever 20.

Figure 7:
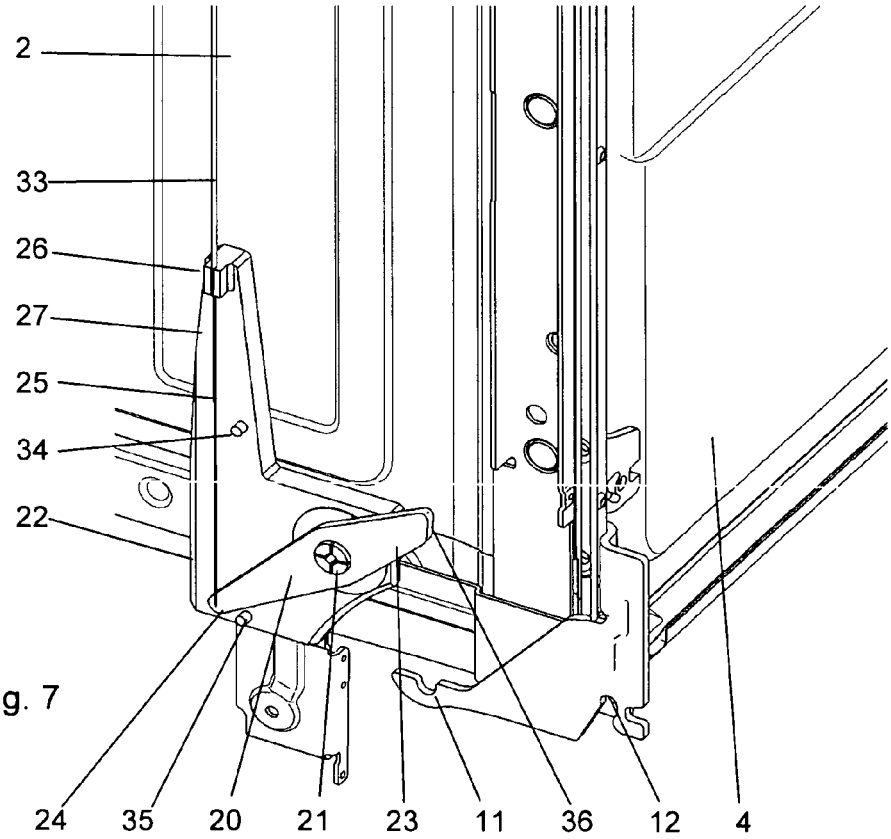
FIG. 7 shows the dishwasher tub of FIG. 6, with the direction-changing lever assembly attached and with the door closed.
Figure 8:
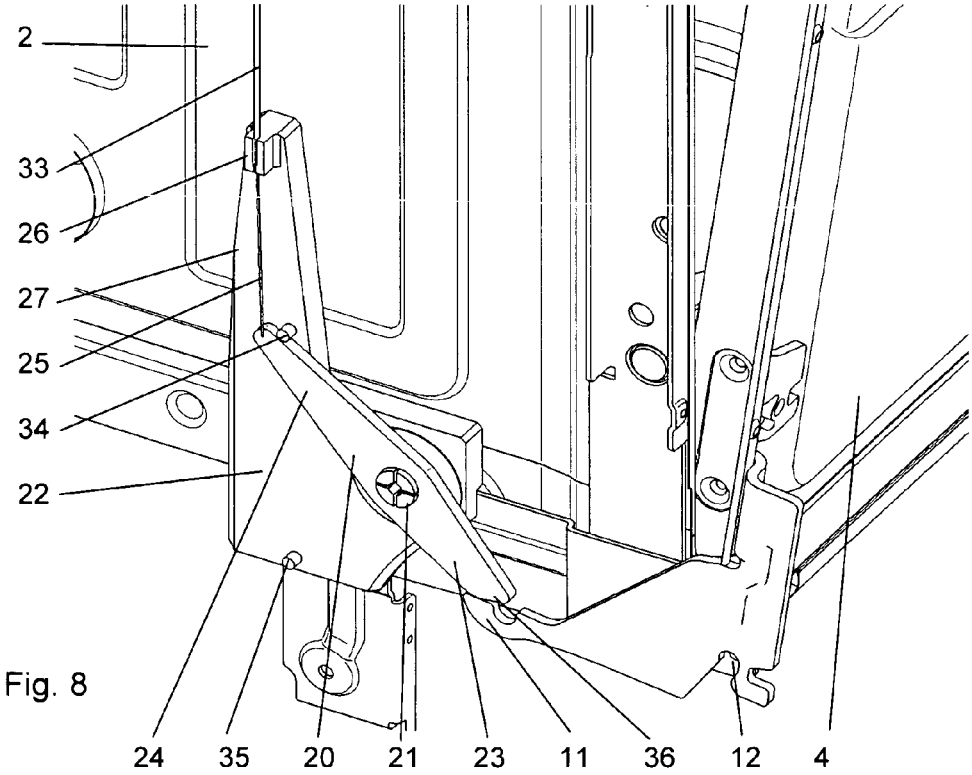
FIG. 8 shows the dishwasher tub of FIG. 6, with the direction-changing lever assembly attached and with the door in an ajar position.
Figure 9:
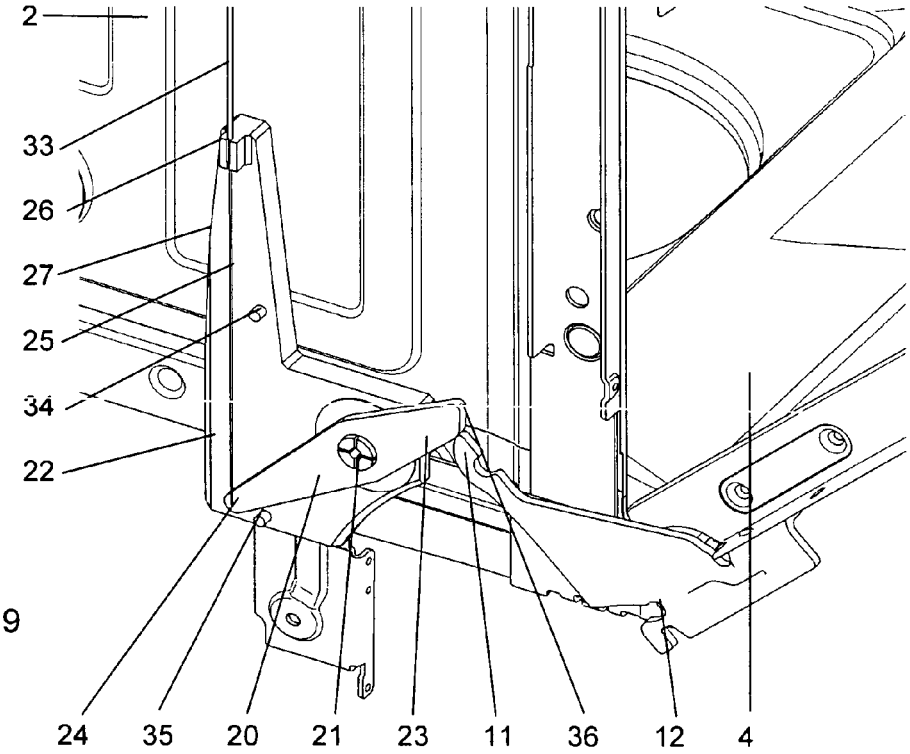
FIG. 9 shows the dishwasher tub of FIG. 6 with the direction-changing lever assembly attached and with the door in a 45-degree open position.

Sequence of Movements:

FIG. 7 shows door 4 and direction-changing lever 20 on a dishwasher in operation. Push rod 6 is in the rear position, as shown in FIG. 2. Accordingly, direction-changing lever 20 rests against lower limit stop 35. Door 4 is closed. Cantilever 11 of door hinge 12 is in the 9 o'clock position and disengaged from direction-changing lever 20.

Figure 3A:
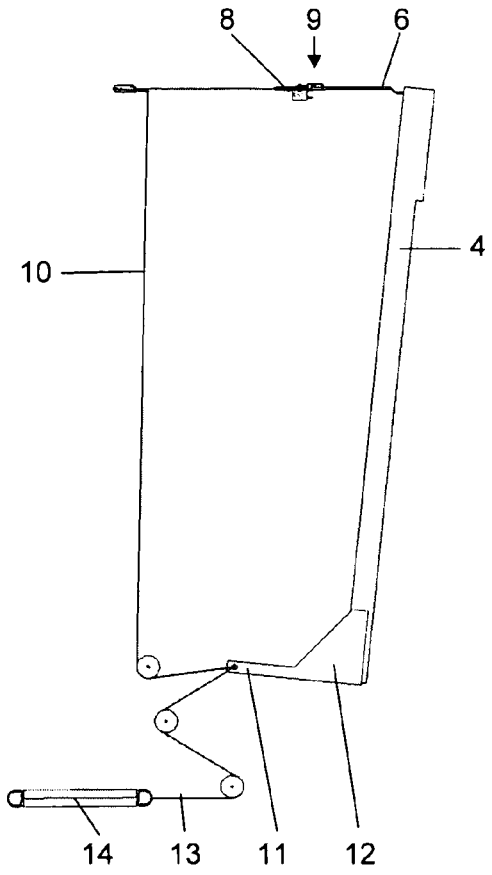
FIGS. 3*a* and 3*b* are side and top views of the door and the latch keeper returning device, with the door in an ajar position.
Figure 3B:
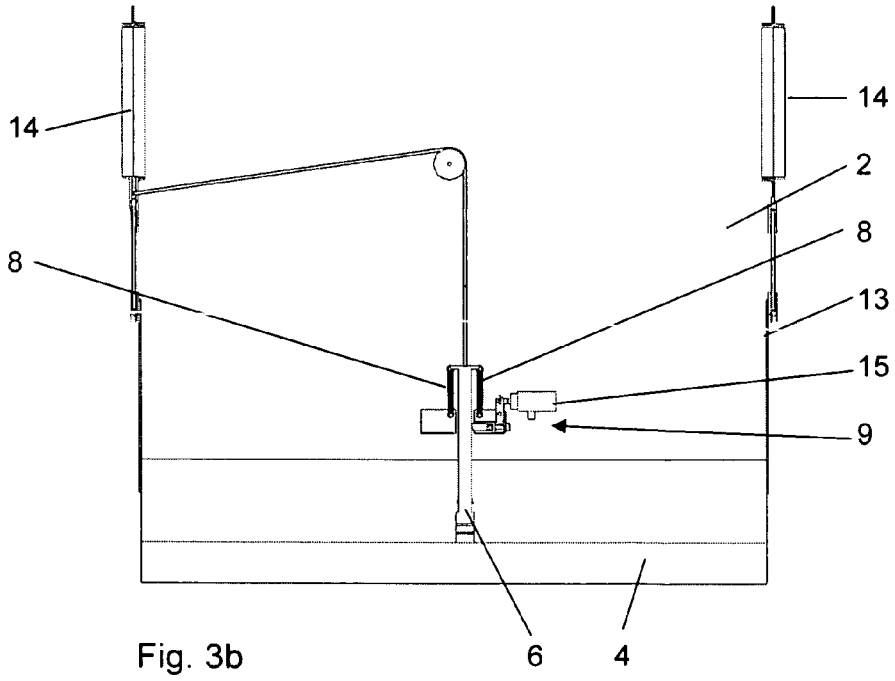

After or at the end of the cycle, tension springs 8 move push rod 6 about 100 mm out of the appliance, as is shown in FIGS. 3*a* and 3*b*. This movement is performed by door 4 as well as by Bowden cable 25 connected to push rod 6 and by direction-changing lever 20 (see FIG. 8). Direction-changing lever 20 now rests against upper limit stop 34, and cantilever 11 of door hinge 12 is in the 10 o'clock position and in contact with first arm 23 of direction-changing lever 20.

Figure 10:
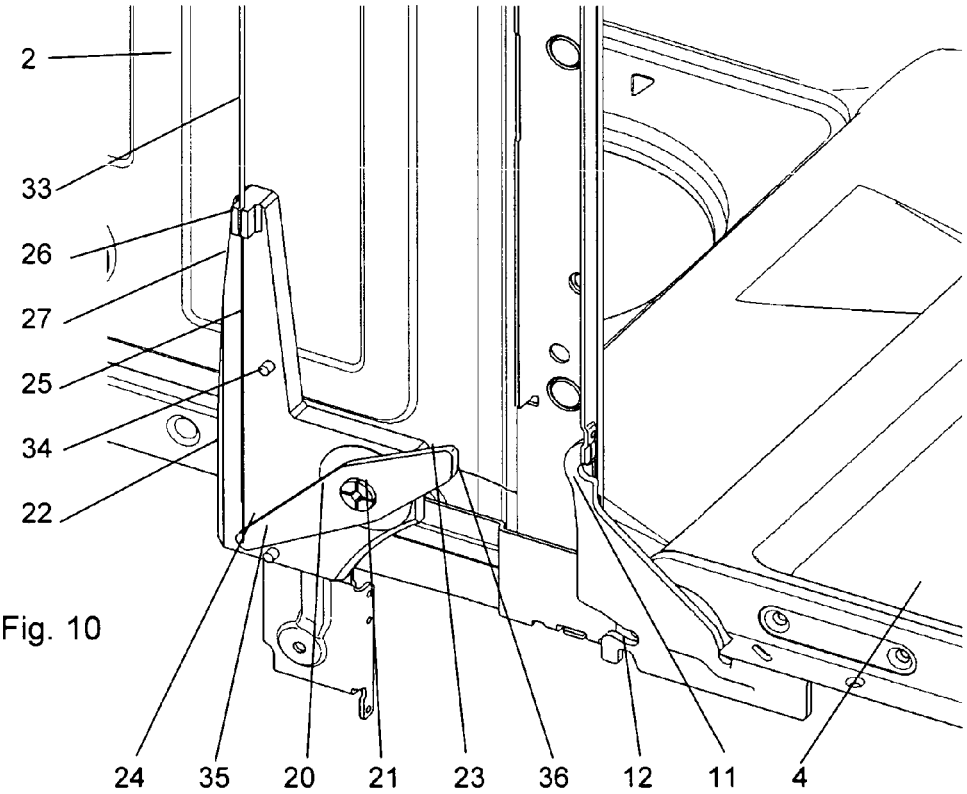
FIG. 10 shows the dishwasher tub of FIG. 6, with the direction-changing lever assembly attached and with the door in a fully open position.

When the user now unlocks the door lock and opens door 4, cantilever 11 swings in a clockwise direction beyond the 11 o'clock position (see FIG. 9) to the 12 o'clock position (see FIG. 10). In the process, cantilever 11 rotates first arm 23 of direction-changing lever 20 in a counterclockwise direction, causing second arm 24 to pull on Bowden cable 25. Bowden cable 25 pulls push rod 6 against the force of springs 8 back to the rear position where it is latched in position, ready for the next automatic opening (see FIGS. 4*a* and 4*b*). In order to ensure that push rod 6 can be securely latched in position, an excess stroke length of several millimeters is provided. Then, cantilever 11 slides along the contour 36 of first arm 23. Once a door-opening angle of 45° is reached, cantilever 11 disengages from direction-changing lever 20, as is illustrated in FIG. 10 for the fully opened door 4.

Support plate 22 and direction-changing lever 20 may be inexpensively manufactured from plastic and can be mounted to dishwasher 1 without requiring any structural modification thereto. The geometry of support plate 22 and direction-changing lever 20 allows movement of Bowden cable 25 without kinking and provides a path length of approximately 100 mm for push rod 6. As a result of the excess stroke length of several millimeters required to latch push rod 6 in position, cantilever 11 comes into contact with direction-changing lever 20. This allows door 4 to be locked in an intermediate opening position of approximately 45°, which makes it easier for the user to fill dispenser reservoirs in door 4.

Figure 11:
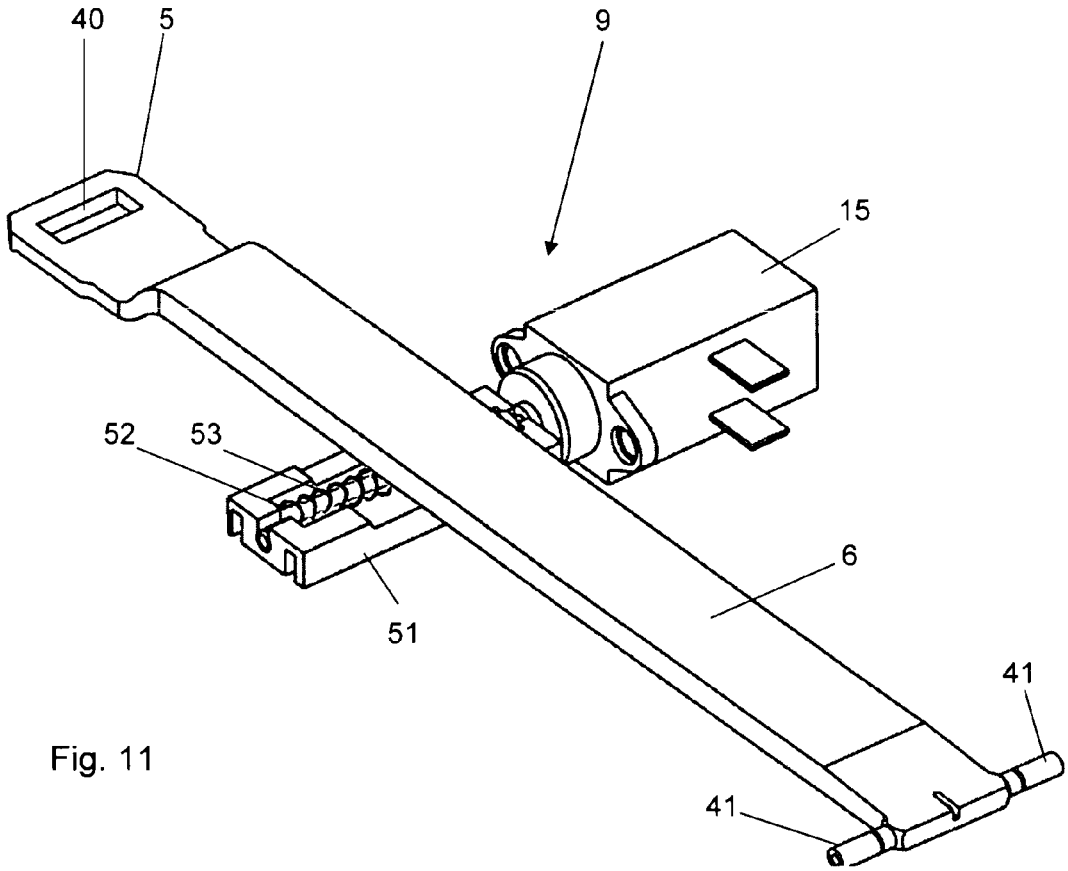
FIG. 11 is an isometric view showing the push rod and a position-locking mechanism.
Figure 12:
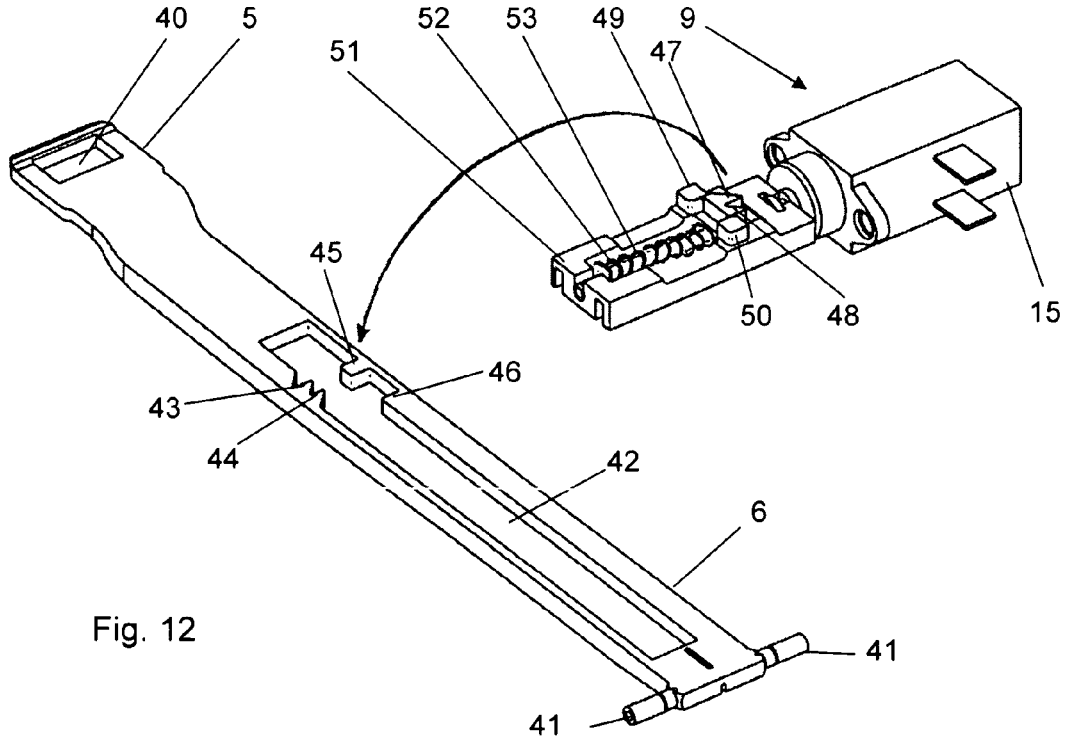
FIG. 12 shows the assembly of FIG. 11 with the push rod flipped over.

In the device for opening door 4 to an ajar position, a locking pawl is released by an actuator 15 (thermal, bimetal or memory metal actuator), so that push rod 6 is moved out by spring force so as to open the door. Since this mechanism solves some problems of detail, it will be described in more detail below:

FIGS. 11 and 12 show push rod 6 and latch keeper 5 integrally formed therewith, as well as an exemplary embodiment of a position-locking mechanism 9. Latch keeper 5 has a rectangular opening 40 for engagement of the lock of door 4. The end of push rod 6 opposite latch keeper 5 has holding pins 41 mounted to the sides thereof for attachment of tension springs 8 (see FIGS. 2 through 4). On the side facing position-locking mechanism 9, push rod 6 has an elongated link slot 42 including projections 43 through 46 and notches therebetween for engagement of different locking elements 47 through 50. Further components include a slide 51, a support rod 52 and a spring 53. Support rod 52 is resiliently supported in slide 51 and has locking elements 47 through 50 disposed at its end. The locking elements include two triangular noses 47 and 48 and two rectangular noses 49 and 50, which act in different directions. Triangular noses 47 and 48 are disposed side-by-side and bordered by rectangular noses 49 and 50. The entire slide 51 is moved by actuator 15 in a direction along support rod 52, and thus transversely to the direction of movement of push rod 6.

The function of actuator 15 is to release the position-locking mechanism of push rod 6, so that the spring force causes the push rod to travel a distance of about 100 mm. If a simple locking pawl were employed, the use of slow actuators 15 would result in a return delay of, for example, at least several seconds in the case of thermal actuators, which can be problematic. During this return delay, the locking pawl would not have returned to the locking position for push rod 6. As a result, the user would not be able to close door 4 during this return time, because push rod 6 would be unable to be locked in the closed position. However, this function is important.

This problem is solved by not using the extension movement of actuator 15, but instead using its return movement to release the position-locking mechanism of push rod 6. Starting from the initial position shown in FIG. 13, actuator 15 moves slide 51 in such a way that triangular noses 47 and 48 are driven out of an initial position (first latched position) and off the projections 43 and 44, while moving rectangular noses 49 and 50 to a second latched position in which they engage projections 45 and 46 (see FIG. 14). During the return movement of actuator 15, slide 51 is withdrawn from the second latched position, thereby releasing push rod 6, whereupon push rod 6 is moved by the force of tension springs 8 (see FIG. 15), and door 4 is moved to a position wherein it is about 100 mm ajar. Push rod 6 may be immediately returned to the first latched position, because triangular noses 43 and 44, which are resiliently supported in slide 51, are able to snap into the first latched position. This is made possible by the spatial arrangement of the first and second latched positions.

In the usual mode of operation, opening of door 4 causes push rod 6 to be returned to the initial position by one of the return devices described above. There, the two triangular noses 47 and 48 snap into projections 43 and 44.

In a further development, after push rod 6 has moved out about 100 mm (FIG. 15), the user may not unlock door 4, but moved it, together with push rod 6, from the position shown in FIG. 1 back to the closed position (FIG. 2). The problem here is that, due to the play between push rod 6 and the door lock, latched position 1 cannot be reached because the opposing forces exerted by the door seal on door 4 are too high.

Figure 16:
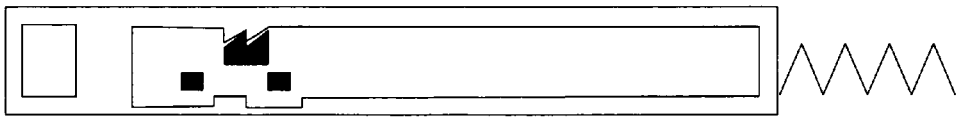
FIGS. 13 through 16 show the push rod and parts of the position-locking mechanism in various latched positions.
Figure 15:
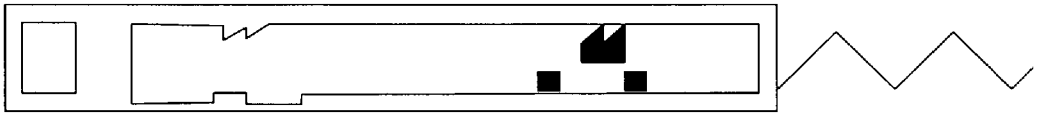
Figure 14:
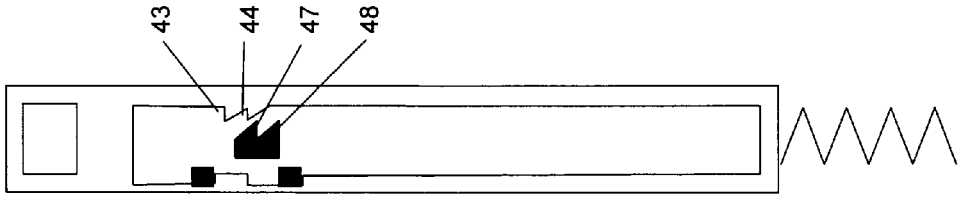
Figure 13:
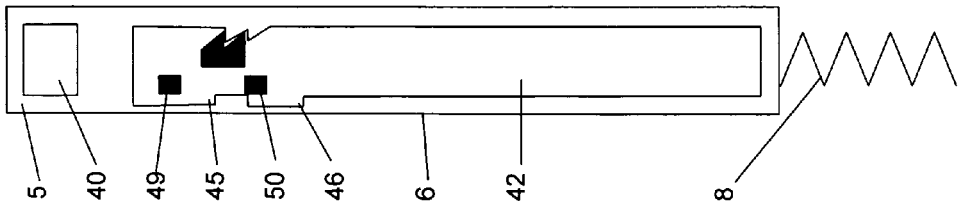

Therefore, the pre-latched position (third latched position) shown in FIG. 16 is provided which is located about 5 mm before the initial position and in which only upper triangular nose 47 engages behind lower projection 44. In this position, the forces of the door seal are not active yet. However, push rod 6 is retracted to a position where it will not hinder the user in the event of manual unlocking The initial starting position (FIG. 13) is reached when, for purposes of unloading, the user opens the door wide enough to allow for the usual mode of operation described above.

The functions described above may be achieved by different types of contours. Preferably, link slot 42 is provided in the form of a groove in push rod 6, which is very advantageous for reasons of space. However, it is also conceivable to provide corresponding contours on the side face of the push rod 6.

Moreover, a solenoid may be used in place of a thermal actuator to move slide 51.

While the invention has been particularly shown and described with reference to preferred embodiments thereof, it will be understood by those skilled in the art that various changes in form and details may be made therein without departing from the spirit and scope of the invention.

What is claimed is:

1. A dishwasher comprising:

a washing tub;

a latch keeper disposed on the washing tub and mounted on a push rod;

a pivotable door configured to close the washing tub, the door including a latching mechanism configured to engage the latch keeper for a closing of the door;

an actuator configured to move the push rod in an opening direction so as to open the door to an ajar position; and a return device including a cable coupled to the door and to the push rod, the cable being configured to pull the push rod in a direction opposite to the opening direction using a force exerted on the door by a further opening of the door so as to return the latch keeper approximately at least to an initial position.

2. The dishwasher as recited in claim 1, wherein the return device includes a cable coupled to the door.

3. The dishwasher as recited in claim 2, wherein the cable includes a Bowden cable.

4. The dishwasher as recited in claim 2, further comprising a pivoted direction-changing lever, and wherein the door is configured to operate the cable via the lever.

5. The dishwasher as recited in claim 4, wherein the direction-changing lever includes a first arm (hat is movable by the door and a second arm attached to the cable.

6. The dishwasher as recited in claim 5, wherein the direction-changing lever is mounted to a support plate.

7. The dishwasher as recited in claim 6, wherein the support plate is attached to at least one of a side wall of the washing tub and a component mounted on the side wall.

8. The dishwasher as recited in claim 1, wherein the actuator includes at least one spring.

9. The dishwasher as recited in claim 8, wherein the spring is configured, upon the further opening of the door, to stretch in a direction opposite to the opening direction of the latch keeper.

10. The dishwasher as recited in claim 9, wherein the push rod is lockable in at least one position corresponding to the spring being tensioned.

11. The dishwasher as recited in claim 10, wherein the push rod is lockable in the initial position of the latch keeper and in a pre-latched position in which the push rod is partially extended in the opening direction.

12. The dishwasher as recited in claim 10, further comprising a release device configured to release a position-locking mechanism engaged with the push rod, and a controller operable to actuate release device so as to release the position-locking mechanism and the push rod.

13. The dishwasher as recited in claim 12, wherein the release device includes a solenoid for releasing the position-locking mechanism.

14. A dishwasher comprising:

a washing tub;

a latch keeper disposed on the washing tub and mounted on a push rod;

a pivotable door configured to close the washing tub, the door including a latching mechanism configured to engage the latch keeper for a closing of the door;

an actuator configured to move the push rod in an opening direction so as to open the door to an ajar position, the actuator including at least one spring, the spring being configured, upon the further opening of the door, to stretch in a direction opposite to the opening direction of the latch keeper; and a return device configured to return the latch keeper in a direction opposite to the opening direction approximately at least to an initial position upon a thither opening of the door;

wherein the push rod is lockable in the initial position of the latch keeper and in a pre-latched position in which the push rod is partially extended in the opening direction, the position corresponding to the spring being tensioned, and wherein the push rod is movable from the pre-latched position to the initial position of the latch keeper upon the door being opened to at least a predetermined minimum angle.

15. A dishwasher comprising:

a washing tub;

a latch keeper disposed on the washing tub and mounted on a push rod;

a pivotable door configured to close the washing tub, the door including a latching mechanism configured to engage the latch keeper for a dosing of the door;

an actuator configured to move the push rod in an opening direction so as to open the door to an ajar position, the actuator including at least one spring, the spring being configured, upon the further opening of the door, to stretch in a direction opposite to the opening direction of the latch keeper;

a return device configured to return the latch keeper in a direction opposite to the opening direction approximately at least to an initial position upon a further opening of the door; and a release device configured to release a position-locking mechanism engaged with the push rod, and a controller operable to actuate the release device so as to release the position-locking mechanism and the push rod;

wherein the push rod is lockable in at least one position corresponding to the spring being tensioned, and wherein the release device includes a thermal actuator configured to release the position-locking mechanism from the push rod.

16. The dishwasher as recited in claim 15, wherein the push rod is configured to remain in an intermediate position after release from the position-locking mechanism until a cooling of the thermal actuator.

* * * * *